United States Patent [19]

Kröner

[11] Patent Number: 4,719,609

[45] Date of Patent: Jan. 12, 1988

[54] HOUR GEAR STRUCTURE OF A WATCH

[75] Inventor: Wolfgang Kröner, Pforzheim, Fed. Rep. of Germany

[73] Assignee: Pforzheimer Uhrenrohwerke PORTA GmbH, Pforzheim, Fed. Rep. of Germany

[21] Appl. No.: 878,344

[22] Filed: Jun. 25, 1986

[30] Foreign Application Priority Data

Jun. 25, 1985 [DE] Fed. Rep. of Germany ..... 3522690

[51] Int. Cl.[4] ..... G04B 19/02; G04B 29/00

[52] U.S. Cl. ..... 368/220; 368/322

[58] Field of Search ..... 368/76, 80, 220, 322–323

[56] References Cited

U.S. PATENT DOCUMENTS

| | | | |
|---|---|---|---|
| 2,618,118 | 11/1952 | Harris et al. | 368/322 |
| 2,952,118 | 9/1960 | Rueger | 368/323 |
| 4,451,161 | 5/1984 | Müller | 368/322 |

*Primary Examiner*—Vit W. Miska

[57] ABSTRACT

An hour gear structure of a watch operating mechanism which comprises a sleeve shaft carrying an hour gear disc and serving as a bearing for the shaft of a minute gear structure, the hour gear is mounted on the sleeve shaft off its axial center so that, when mounted on the base plate of a watch's operating mechanism, its projection length from the base plate may be made different for different applications depending on whether the longer or shorter sleeve shaft section is inserted through the support opening in the base plate.

3 Claims, 1 Drawing Figure

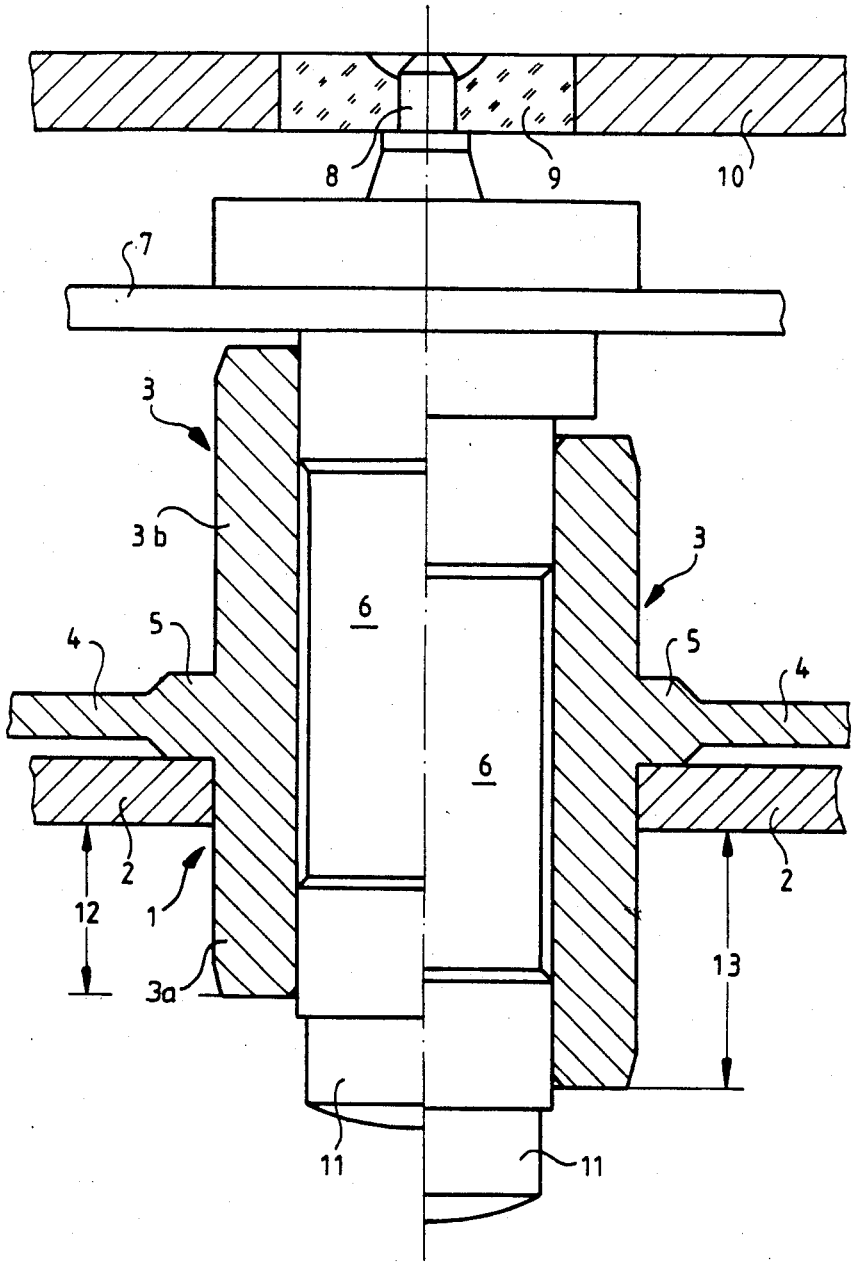
8
9
10
7
3
3b
3
6
5
5
4
4
6
2
2
12
1
13
3a
11
11

HOUR GEAR STRUCTURE OF A WATCH

BACKGROUND OF THE INVENTION

The invention relates to an hour gear structure of a watch drive mechanism wherein the hour gear structure includes a bearing sleeve on which an hour hand is disposed and which serves as bearing for the minute gear.

Since the hour gear of a watch operating mechanism rotates only once per hour there is no need to provide an expensive bearing structure for the hour gear. Rather the hour gear is generally simply mounted on a bearing sleeve or it is formed integral with the bearing sleeve and the bearing sleeve is disposed in a corresponding bore in the operating mechanism base plate such that the center collar with which the gear is provided abuts the base plate. A minute gear structure shaft is supported centrally within the sleeve-type hour gear shaft and is additionally supported at its end opposite the minute hand by way of a trunnion which extends into a bearing in a gear shaft support plate spaced from, and parallel to, the base plate.

With watch operating mechanisms of generally the same type there is sometimes the need to provide for a shaft sleeve of the hour gear as well as the minute gear shaft which are shorter or possibly longer in some than in other operating mechanisms in production such that the sleeve shaft projects from the base plate to a smaller or greater extent. This requires the manufacture of a different minute gear structure and heretofore also the manufacture of a different hour gear structure including the sleeve shaft.

SUMMARY OF THE INVENTION

In order to avoid the need for the manufacture at least of a different hour gear structure for similar watches, the hour gear is mounted on the gear sleeve shaft off its axial center so that by reversing the position of the sleeve shaft the shorter or the longer part of the sleeve shaft extends through the base plate such that the sleeve shaft projects from the base plate to a smaller or greater degree. Generally there are only two desired lengths of projections from the base plate of the sleeve shafts and also of the minute gear shafts so that the hour gear structure and the watch may be designed in such a manner that only one type of gear structure may be utilized for both arrangements. This of course results in improved rationalization of the manufacture and also the storage of parts and therefore also in a reduction in manufacturing costs, not to mention the storage of repair parts.

SHORT DESCRIPTION OF THE DRAWINGS

The single FIGURE shows schematically the hour gear structure in accordance with the invention.

DESCRIPTION OF THE PREFERRED EMBODIMENT

As shown in the FIGURE, the base plate 2 of a watch operating mechanism has an opening 1 extending therethrough which opening receives the sleeve shaft 3 of an hour gear 4 in such a manner that a collar 5 of the hour gear 4 abuts the base plate 2. Rotatably supported within the sleeve shaft 3 is the shaft 6 of a minute gear 7 which is mounted on the shaft 6, the shaft 6 being rotatably supported at the opposite side of the gear 7 by a trunnion 8 projecting from the shaft 6 into a bearing 9 which is supported in a gear support plate 10 spaced from the base plate 2. The portion 3*a* of the sleeve shaft 3 which projects through the base plate 2 carries the hour hand (which is not shown). The minute hand is disposed on a lug 11 projecting from the shaft 6 of the minute gear structure 7.

As it is apparent from the drawing the hour gear 4 is mounted on the sleeve shaft 3 off its center so that the sleeve shaft is divided by the gear 4 into two sections 3*a* and 3*b* of differnt lengths. In this manner it is possible to utilize the same sleeve shaft 3 to provide for a short projection 12 as shown on the left-hand side of the shaft center line or for a larger projection 13 as shown on the right-hand side of the shaft center line. The minute gear structure 6, 7 however must be manufactured separately for the shorter or longer version since it is supported in the gear support plate 10 and since the area of engagement of its gear with the rest of the watch operating mechanism remains unchanged, that is, versions with long and other versions with short shafts have to be made.

The sleeve shaft sections at opposite sides of the hour gear may have the same outer diameters so that the opening in the base plates of both watch versions may be the same. However, sleeve shaft sections with different diameters on opposite sides of the hour gear may be desirable, for example, in order to avoid errors in the assembly of the watches.

What is claimed is:

1. In the method of manufacturing two different types of watch operating mechanisms each having an hour gear structure comprising a sleeve shaft carrying an hour gear disc and serving as a bearing for the shaft of a minute gear structure, the gear disc being mounted on the sleeve shaft off its axial center such the sleeve has different axial lengths at opposite sides of said gear disc, said method comprising the steps of:

utilizing a single sleeve shaft hour gear structure for the two different types of watch operating mechanisms by appropriate selection of said sleeve lengths, mounting the gear structure in one of said different types of watch operating mechanisms such that the longer and shorter sleeve shaft sections are oriented in one sense, and mounting said gear structure in the other of said different types of watch operating mechanisms such the longer and shorter sleeve sections are oriented therein in the opposite sense.

2. An hour gear structure according to claim 1, wherein the outer diameters of the sleeve shaft sections at opposite sides of the hour gear disc are identical.

3. An hour gear structure according to claim 1, wherein the sleeve shaft sections at opposite sides of the hour gear disc are of different outer diameters.

* * * * *